US009666990B1

(12) United States Patent
de Boer et al.

(10) Patent No.: US 9,666,990 B1
(45) Date of Patent: May 30, 2017

(54) PLUG CONNECTOR HAVING RESONANCE CONTROL

(71) Applicant: TYCO ELECTRONICS CORPORATION, Berwyn, PA (US)

(72) Inventors: Thomas Taake de Boer, Hummelstown, PA (US); Michael John Phillips, Camp Hill, PA (US); John Joseph Consoli, Harrisburg, PA (US); Sandeep Patel, Middletown, PA (US); Bruce Allen Champion, Camp Hill, PA (US); Linda Ellen Shields, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/053,637

(22) Filed: Feb. 25, 2016

(51) Int. Cl.
*H01R 13/6471* (2011.01)
*H01R 12/72* (2011.01)
*H01R 24/66* (2011.01)

(52) U.S. Cl.
CPC ..... *H01R 13/6471* (2013.01); *H01R 12/721* (2013.01); *H01R 24/66* (2013.01)

(58) Field of Classification Search
CPC ..... H01R 13/6658; H01R 13/6471; H01R 13/6461; H01R 13/6608
USPC ..... 439/607.05–607.07, 620.71
See application file for complete search history.

(56) References Cited

U.S. PATENT DOCUMENTS

| | | | | |
|---|---|---|---|---|
| 7,371,117 | B2 | 5/2008 | Gailus | |
| 8,083,553 | B2 * | 12/2011 | Manter | H01R 13/514 439/607.05 |
| 8,177,564 | B1 | 5/2012 | Ito et al. | |
| 8,523,583 | B2 | 9/2013 | Ito | |
| 8,657,627 | B2 * | 2/2014 | McNamara | H01R 13/6461 439/108 |
| 2007/0004282 | A1 * | 1/2007 | Cohen | H01R 13/514 439/607.02 |
| 2009/0029602 | A1 * | 1/2009 | Cohen | H01R 13/6658 439/719 |
| 2009/0291593 | A1 * | 11/2009 | Atkinson | H01R 13/6471 439/607.06 |
| 2011/0287663 | A1 * | 11/2011 | Gailus | H01R 13/6608 439/620.21 |
| 2013/0012038 | A1 * | 1/2013 | Kirk | H01R 12/724 439/55 |
| 2013/0109232 | A1 * | 5/2013 | Paniaqua | H01R 13/6581 439/607.07 |

(Continued)

*Primary Examiner* — Gary Paumen

(57) ABSTRACT

A plug connector includes a plug body having a terminating end terminated to an electrical component and a mating end mated with a mating electrical connector. The plug body has first and second outer sides. The plug body has pockets between the first and second outer sides. A plug shroud extends from the plug body at the terminating end that is configured to be coupled to the electrical component. A contact array is held by the plug body and includes signal and ground contacts. The signal and ground contacts are exposed along the first and second outer sides. At least some of the ground contacts are aligned with corresponding pockets. Resonance-control lossy inserts are provided in corresponding pockets adjacent corresponding ground contacts. The lossy inserts are manufactured from lossy material capable of absorbing electrical resonance propagating through the plug body.

19 Claims, 5 Drawing Sheets

(56) References Cited

U.S. PATENT DOCUMENTS

| | | | | |
|---|---|---|---|---|
| 2014/0004746 | A1* | 1/2014 | Cartier, Jr. ..... | H01R 12/712<br>439/626 |
| 2014/0127946 | A1 | 5/2014 | Ito et al. | |
| 2015/0255904 | A1 | 9/2015 | Ito | |

* cited by examiner

PLUG CONNECTOR HAVING RESONANCE CONTROL

BACKGROUND OF THE INVENTION

The subject matter herein relates generally to electrical connectors that have signal and ground contacts.

Communication systems exist today that utilize electrical connectors to transmit data. For example, network systems, servers, data centers, and the like may use numerous electrical connectors to interconnect the various devices of the communication system. Many electrical connectors include signal conductors and ground conductors in which the signal conductors convey data signals and the ground conductors reduce crosstalk and/or electromagnetic interference (EMI) between the signal conductors. In differential signaling applications, the signal conductors are arranged in signal pairs for carrying the data signals. Each signal pair may be separated from an adjacent signal pair by one or more ground conductors.

There has been a general demand to increase the density of signal conductors within the electrical connectors and/or increase the speeds at which data is transmitted through the electrical connectors. As data rates increase and/or distances between the signal conductors decrease, however, it becomes more challenging to maintain a baseline level of signal integrity. For example, in some cases, electrical energy that flows through (for example, on the surface of) each ground conductor of the electrical connector may be reflected and resonate within cavities formed between ground conductors. Unwanted electrical energy, such as EMI, may be supported between nearby ground conductors. Depending on the frequency of the data transmission, electrical noise may develop that increases return loss and/or crosstalk and reduces throughput of the electrical connector.

Accordingly, there is a need for electrical connectors that reduce the electrical noise and interference caused by resonating conditions between ground conductors.

BRIEF DESCRIPTION OF THE INVENTION

In an embodiment, a plug module is provided including a plug body having a terminating end configured to terminate to an electrical component and a mating end configured to mate with a mating electrical connector. The plug body has a first outer side and a second outer side. The plug body has pockets between the first and second outer sides. A plug shroud extends from the plug body at the terminating end. The plug shroud is configured to be coupled to the electrical component. A contact array is held by the plug body. The contact array has signal contacts and ground contacts interleaved between corresponding signal contacts. The signal and ground contacts are exposed along the first and second outer sides. At least some of the ground contacts are aligned with corresponding pockets. Resonance-control lossy inserts are provided in corresponding pockets adjacent corresponding ground contacts. The lossy inserts are manufactured from lossy material capable of absorbing electrical resonance propagating through the plug body.

In another embodiment, a plug connector is provided including a circuit board having a card edge between first and second sides of the circuit board. The circuit board has signal and ground conductors on the first and second sides of the circuit board proximate to the card edge. A plug module is coupled to the card edge of the circuit board. The plug module includes a plug body having a terminating end terminated to the card edge of the circuit board and a mating end configured to mate with a mating electrical connector. The plug body has a first outer side and a second outer side. The plug body has pockets between the first and second outer sides. A plug shroud extends from the plug body at the terminating end. The plug shroud receives the card edge of the circuit board. A contact array is held by the plug body. The contact array has signal contacts and ground contacts interleaved between corresponding signal contacts. The signal and ground contacts are exposed along the first and second outer sides. At least some of the ground contacts are aligned with corresponding pockets. The signal and ground contacts have terminating ends extending from the terminating end of the plug body. The terminating ends of the signal and ground contacts are terminated to corresponding signal and ground conductors of the circuit board. Resonance-control lossy inserts are provided in corresponding pockets adjacent corresponding ground contacts. The lossy inserts are manufactured from lossy material capable of absorbing electrical resonance propagating through the plug body.

In another embodiment, a plug connector is provided including a wire harness having a plurality of wires. A plug module is provided at the end of the wire harness. The plug module includes a plug body having a terminating end and a mating end opposite the terminating end configured to mate with a mating electrical connector. The plug body has a first outer side and a second outer side. The plug body has pockets between the first and second outer sides. A plug shroud extends from the plug body at the terminating end. The plug shroud defines a cavity receiving the wires of the wire harness. A contact array is held by the plug body. The contact array has signal contacts and ground contacts interleaved between corresponding signal contacts. The signal and ground contacts are exposed along the first and second outer sides. At least some of the ground contacts are aligned with corresponding pockets. The signal and ground contacts having terminating ends being electrically connected to corresponding wires of the wire harness. Resonance-control lossy inserts are provided in corresponding pockets adjacent corresponding ground contacts. The lossy inserts are manufactured from lossy material capable of absorbing electrical resonance propagating through the plug body.

DETAILED DESCRIPTION OF THE INVENTION

Embodiments set forth herein may include various electrical connectors that are configured for communicating data signals. The electrical connectors may mate with a corresponding mating connector to communicatively interconnect different components of a communication system. In the illustrated embodiment, the electrical connector is a plug connector, which may be terminated to and electrically coupled to another electrical component, such as a circuit board, a wire harness or another electrical component. The plug connector may be a pluggable input/output (I/O) connector, which may be mated with a corresponding receptacle connector during a mating operation. It should be understood, however, that the inventive subject matter set forth herein may be applicable in other types of electrical connectors.

In various embodiments, the electrical connectors provide lossy ground inserts to provide resonance control. Moreover, in various embodiments, the electrical connectors are particularly suitable for high-speed communication systems, such as network systems, servers, data centers, and the like, in which the data rates may be greater than 5 gigabits/second (Gbps). However, one or more embodiments may also be suitable for data rates less than 5 Gbps.

In various embodiments described and/or illustrated herein, the electrical connectors include signal and ground conductors that are positioned relative to each other to form a pattern or array that includes one or more rows (or columns). The signal and ground conductors of a single row (or column) may be substantially co-planar. The signal and ground conductors may be vertical or straight conductors, may be right-angle conductors having a generally 90° bend along the length of the conductors, or may have other arrangements. The signal conductors may form signal pairs in which each signal pair is flanked on both sides by ground conductors. The ground conductors electrically separate the signal pairs to reduce electromagnetic interference or cross-talk and to provide a reliable ground return path. The signal and ground conductors in a single row are patterned to form multiple sub-arrays. Each sub-array includes, in order, a ground conductor, a signal conductor, a signal conductor, and a ground conductor. This arrangement is referred to as ground-signal-signal-ground (or GSSG) sub-array. The sub-array may be repeated such that an exemplary row of conductors may form G-S-S-G-G-S-S-G-G-S-S-G, wherein two ground conductors are positioned between two adjacent signal pairs. In the illustrated embodiment, however, adjacent signal pairs share a ground conductor such that the pattern forms G-S-S-G-S-S-G-S-S-G. In both examples above, the sub-array is referred to as a GSSG sub-array. More specifically, the term "GSSG sub-array" includes sub-arrays that share one or more intervening ground conductors.

Figure 1:
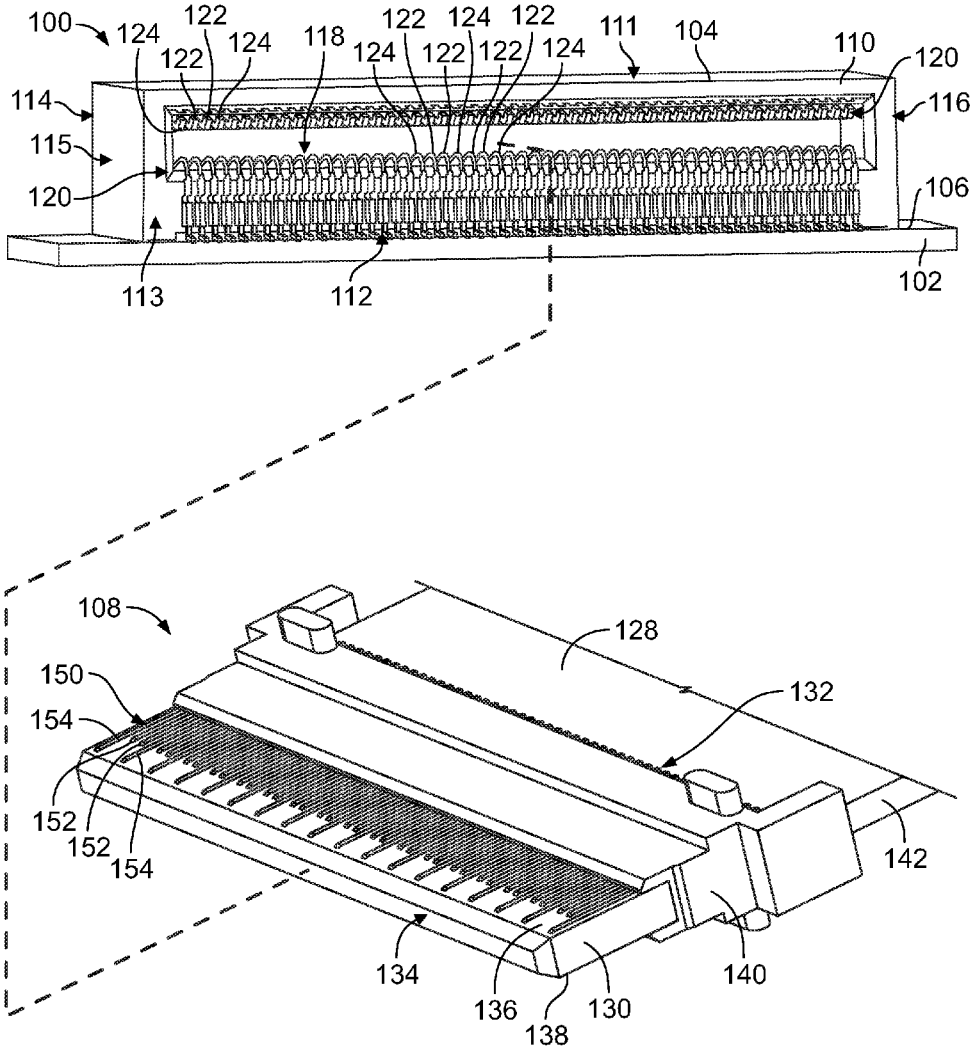
FIG. 1 is a perspective view of a communication system formed in accordance with an embodiment.

FIG. 1 is a perspective view of a communication system 100 formed in accordance with an embodiment. The communication system 100 includes a circuit board 102 and an electrical connector 104 that is mounted onto a board surface 106 of the circuit board 102. The electrical connector 104 is used for data communication. In an exemplary embodiment, the electrical connector 104 is a receptacle connector and may be referred to hereinafter as a receptacle connector 104. The communication system 100 includes a plug connector 108 configured to be plugged into the receptacle connector 104 for electrical connection thereto. The receptacle connector 104 defines a mating electrical connector for the plug connector 108. The plug connector 108 is electrically connected to an electrical component. For example, the plug connector 108 may be provided at an end of a circuit board, as in the illustrated embodiment, or may be provided at an end of a wire harness or another type of electrical component.

In some embodiments, the electrical connector 104 may be part of a daughter card assembly that is configured to engage a backplane or midplane communication system (not shown). In various embodiments, the communication system 100 may include a plurality of the electrical connectors 104 mounted to the circuit board 102 along an edge of the circuit board 102 in which each of the electrical connectors 104 is configured to engage a corresponding pluggable input/output (I/O) mating electrical connector, such as the plug connector 108. The electrical connector 104 and plug connector 108 may be configured to satisfy certain industry standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard. In some embodiments, the plug connector 108 may be configured to be compliant with a small form factor (SFF) specification, such as SFF-8644 and SFF-8449 HD. The electrical connector 104 and the plug connector 108 may be high-speed electrical connectors that are capable of transmitting data at a rate of at least about five (5) gigabits per second (Gbps), at least about 10 Gbps, at least about 20 Gbps, at least about 40 Gbps, or more. Although not shown, the electrical connector 104 optionally may be positioned within a receptacle cage. The receptacle cage may be configured to receive the plug connector 108 during a mating operation and direct the plug connector 108 toward the electrical connector 104. The communication system 100 may also include other devices that are communicatively coupled to the electrical connector 104 through the circuit board 102. The electrical connector 104 may be located proximate to an edge of the circuit board 102.

The electrical connector 104 includes a housing 110 having a plurality of walls, including a first end 111, a second end 112, a front end 113, a rear end 114, a first side 115 and a second side 116. The housing 110 may include greater or fewer walls in alternative embodiments. The housing sides 115, 116 extend between the front and rear ends 113, 114 and the first and second ends 111, 112. The front end 113 and the rear end 114 face in opposite directions. The first and second sides 115, 116 face in opposite directions. The first and second ends 111, 112 face in opposite directions. The housing 110 extends a height between the first end 111 and the second end 112. The housing 110 extends a width between the front end 113 and the rear end 114. The housing 110 extends a length between the first and second sides 115, 116.

In the illustrated embodiment, the first end 111 defines a top end and may be referred to hereinafter as a top end 111 and the second end 112 defines a bottom end and may be referred to hereinafter as a bottom end 112. The bottom end 112 faces the board surface 106 and may be mounted to or engage the board surface 106. The top end 111 faces away from the circuit board 102 and may have the greatest elevation of the housing walls with respect to the board surface 106.

In the illustrated embodiment of FIG. 1, the electrical connector 104 is a right-angle connector such that the front end 113 (which is the receiving side) and the bottom end 112 (which is the mounting side) are oriented substantially perpendicular or orthogonal to each other. More specifically, the front end 113 faces in a receiving direction and the mounting side faces in a mounting direction. In other embodiments, the receiving side and the mounting side may face in different directions than those shown in FIG. 1. For example, the top end 111 may define the receiving side that receives the plug connector 108 such that the electrical connector 104 is a vertical connector rather than a right-angle connector.

The housing 110 includes a mating slot 118 (FIG. 1) that is sized and shaped to receive a portion of the plug connector 108. For example, in the illustrated embodiment, the mating slot 118 is sized and shaped to receive an edge of the plug connector 108. The mating slot 118 is positioned between the top and bottom ends 111, 112. The mating slot 118 is open at the front end 113 with an upper portion of the housing 110 positioned between the mating slot 118 and the top end 111 and a lower portion of the housing 110 positioned between the mating slot 118 and the bottom end 112. The mating slot 118 is shown open at the front end 113; however the mating slot 118 may have other locations in alternative embodiments, such as open at the top end 111 and being oriented vertically.

The receptacle connector 104 includes one or more contact arrays 120 having signal conductors 122 and ground conductors 124 that are held in the housing 110. In an exemplary embodiment, the signal and ground conductors 122, 124 are arranged in two rows on opposite sides of the mating slot 118, such as in an upper row and a lower row as in the illustrated embodiment. The signal and ground conductors 122, 124 are configured to be terminated to the circuit board 102. For example, terminating ends thereof may be soldered or welded to traces or contact pads (not shown) of the circuit board. Alternatively, the terminating ends may form compliant pins that are inserted into plated thru-holes (PTHs) (not shown) of the circuit board 102.

In an embodiment, the signal conductors 122 are arranged to form a plurality of signal pairs that are configured to carry differential signals. The ground conductors 124 are interleaved between the signal pairs of signal conductors 122. For example, the signal and ground conductors 122, 124 may be arranged in a plurality of ground-signal-signal-ground (GSSG) sub-arrays in which each pair of signal conductors 122 is located between two ground conductors 124. The signal pair in each GSSG sub-array is disposed between first and second ground conductors 124 that separate the corresponding signal pair from adjacent signal pairs.

The plug connector 108 is terminated to an electrical component 128 and is configured to mate with the electrical connector 104. The plug connector 108 is pluggable into the slot 118 of the receptacle connector 104 to provide an electrically conductive signal path across the connectors 104, 108 between the electrical component 128 and the circuit board 102. The plug connector 108 includes a plug body 130 having a terminating end 132 terminated to the electrical component 128 and a mating end 134 capable of mating with a mating connector, such as the electrical connector 104. The plug body 130 has a first outer side 136 and a second outer side 138 opposite the first outer side 136.

A plug shroud 140 extends from the plug body 130 at the terminating end 132. The plug shroud 140 is configured to be coupled to the electrical component 128. Optionally, the plug shroud 140 may be a separate component from the plug body 130 and mechanically secured thereto. For example, the plug shroud 140 may be a dielectric housing that receives and holds the plug body 130. The plug shroud 140 may receive or extend at least partially around a portion of the electrical component 128. For example, in an exemplary embodiment, the electrical component 128 includes a circuit board 142 coupled to the plug shroud 140 and/or the terminating end 132 of the plug body 130. An edge of the circuit board 142 may be received in the plug shroud 140. In other various embodiments, the plug shroud 140 may be part of the plug body 130 or the plug connector 108 may be devoid of the plug shroud 140.

A contact array 150 is held by the plug body 130. The contact array 150 has signal contacts 152 and ground contacts 154 interleaved between corresponding signal contacts 152. Optionally, the signal and ground contacts 152, 154 may be loaded into the plug body 130, such as being stitched into the plug body 130. Alternatively, the signal and ground contacts 152, 154 may be overmolded by at least one overmold body that defines the plug body 130. The signal and ground contacts 152, 154 are exposed along the first and second outer sides 136, 138. The signal and ground contacts 152, 154 are configured to be mated with both rows of signal and ground conductors 122, 124 of the electrical connector 104 when the plug body 130 is plugged into the mating slot 118. In other various embodiments, the signal and ground contacts 152, 154 may be provided on only one of the outer sides 136 or 138, such as for mating with a single row of signal and ground conductors 122, 124. The signal contacts 152 and the ground contacts 154 of the plug connector 108 may be arranged similar to the signal conductors 122 and the ground conductors 124, respectively, of the receptacle connector 104. For example, the signal and ground contacts 152, 154 may be arranged in at least one plug conductor array that includes a plurality of GSSG sub-arrays along a row.

In an exemplary embodiment, the plug connector 108 includes at least one resonance-control lossy insert 160 (shown in phantom in FIG. 2 and also shown in FIG. 3) provided in the plug body 130. The lossy inserts 160 are distributed throughout the plug body 130 in select locations, such as adjacent to corresponding ground contacts 154. Each of the lossy inserts 160 is configured to absorb at least some electrical resonance that propagates along the current path defined by the ground contacts 154 and/or at least some electrical resonance that propagates along the signal path defined by the corresponding signal contacts 152. The lossy insert 160 may be coupled to one or more ground contacts 154, such as directly coupled to the one or more ground contacts 154 at a ground contact interface that directly engages the corresponding ground contact 154. The lossy insert 160 may control or limit undesirable resonances that occur within the ground contacts 154 during operation of the electrical connector 104. The lossy insert 160 may effectively reduce the frequency of energy resonating within the plug body 130. The bulk of the material of the plug body 130 is manufactured from a low loss dielectric material, such as a plastic material. The low loss dielectric material has dielectric properties that have relatively little variation with frequency.

The lossy insert 160 may be provided at any location along the length of the plug body 130, such as approximately centered between the terminating end 132 and the mating end 134. The lossy insert 160 may extend any depth within the plug body 130 between the first and second outer sides 136, 138 and may extend substantially the entire depth to couple to ground contacts 154 on both outer sides 136, 138. The lossy insert 160 may directly engage the ground contacts 154 or may be in close proximity such that the lossy insert 160 is capacitively or otherwise electrically coupled to the ground contacts 154. Optionally, the lossy insert 160 may span across all or a portion of the width of the plug body 130, such as to interface with multiple ground contacts 154 on the first outer side 136 and/or multiple ground contacts 154 on the second outer side 138. For example, the lossy insert 160 may pass across the signal contacts 152, within the thickness of the plug body 130, to ground contacts 154 on opposite sides of the signal contacts 152.

In an exemplary embodiment, the lossy insert 160 includes lossy material capable of absorbing at least some electrical resonance that propagates along the current paths defined by the signal contacts 152 and/or the ground contacts 154 through the electrical connector 108. For example, the lossy material may be embedded in the plug body 130. The lossy material has dielectric properties that vary with frequency. The lossy material provides lossy conductivity and/or magnetic lossiness through a portion of the electrical connector 104. The lossy material is able to conduct electrical energy, but with at least some loss. The lossy material is less conductive than conductive material, such as the conductive material of the contacts 152, 154. The lossy material may be designed to provide electrical loss in a certain, targeted frequency range, such as by selection of the lossy material, placement of the lossy material, proximity of the lossy material to the ground paths and the signal paths, and the like. The lossy material may include conductive particles (or fillers) dispersed within a dielectric (binder) material. The dielectric material, such as a polymer or epoxy, is used as a binder to hold the conductive particle filler elements in place. These conductive particles then impart loss to the lossy material. In some embodiments, the lossy material is formed by mixing binder with filler that includes conductive particles. Examples of conductive particles that may be used as a filler to form electrically lossy materials include carbon or graphite formed as fibers, flakes, or other particles. Metal in the form of powder, flakes, fibers, or other conductive particles may also be used to provide suitable lossy properties. Alternatively, combinations of fillers may be used. For example, metal plated (or coated) particles may be used. Silver and nickel may also be used to plate particles. Plated (or coated) particles may be used alone or in combination with other fillers, such as carbon flakes. In some embodiments, the fillers may be present in a sufficient volume percentage to allow conducting paths to be created from particle to particle. For example when metal fiber is used, the fiber may be present at an amount up to 40% by volume or more. The lossy material may be magnetically lossy and/or electrically lossy. For example, the lossy material may be formed of a binder material with magnetic particles dispersed therein to provide magnetic properties. The magnetic particles may be in the form of flakes, fibers, or the like. Materials such as magnesium ferrite, nickel ferrite, lithium ferrite, yttrium garnet and/or aluminum garnet may be used as magnetic particles. In some embodiments, the lossy material may simultaneously be an electrically-lossy material and a magnetically-lossy material. Such lossy materials may be formed, for example, by using magnetically-lossy filler particles that are partially conductive or by using a combination of magnetically-lossy and electrically-lossy filler particles As used herein, the term "binder" encompasses material that encapsulates the filler or is impregnated with the filler. The binder material may be any material that will set, cure, or can otherwise be used to position the filler material. In some embodiments, the binder may be a thermoplastic material such as those traditionally used in the manufacture of electrical connector housings. The thermoplastic material may be molded, such as molding of the lossy insert 160 into the desired shape and/or location. However, many alternative forms of binder materials may be used. Curable materials, such as epoxies, can serve as a binder. Alternatively, materials such as thermosetting resins or adhesives may be used.

Electrical performance of the plug connector 108 is enhanced by the inclusion of the lossy material in the lossy inserts 160. For example, at various data rates, including high data rates, return loss is inhibited by the lossy material. For example, the return loss of the small pitch, high speed data of the contact arrays due to the close proximity of signal and ground contacts 152, 154 is reduced by the lossy inserts 160. For example, energy from the ground contacts 154 on either side of the signal pair reflected in the space between the ground contacts 154 is absorbed, and thus connector performance and throughput are enhanced.

Figure 2:
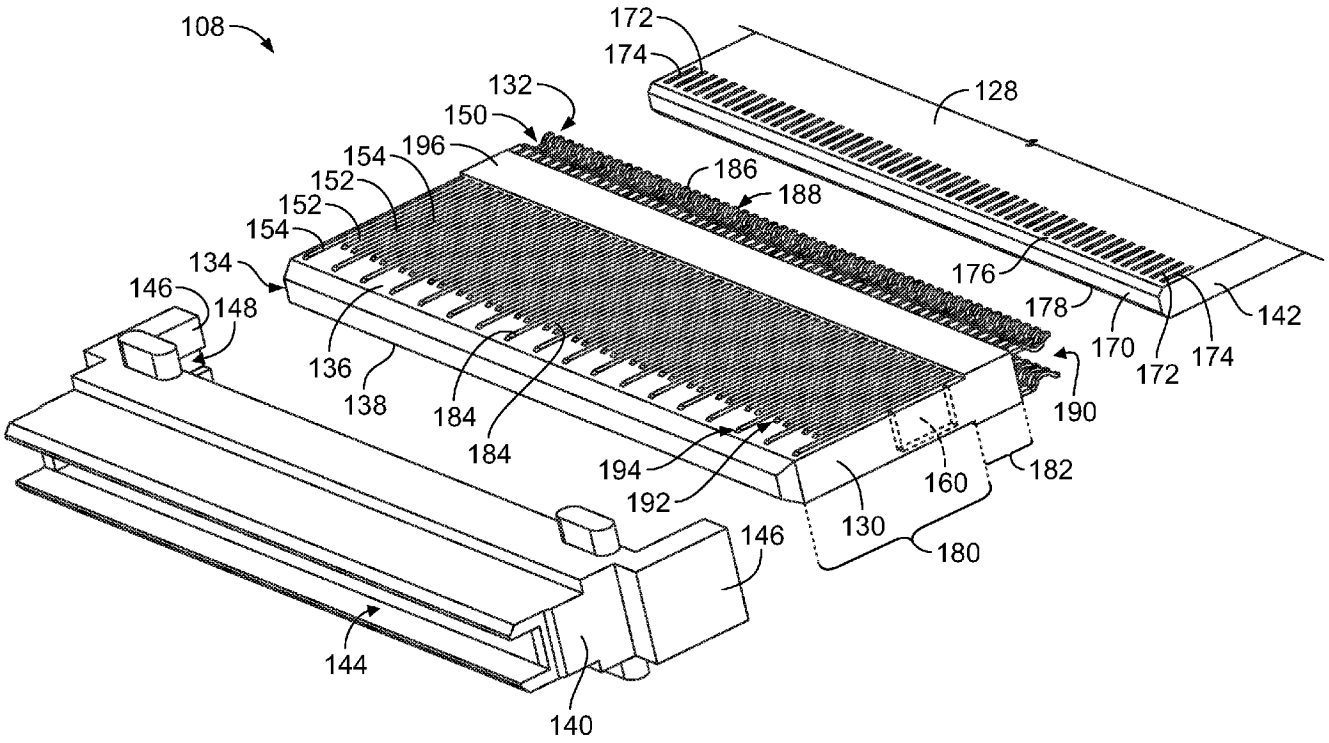
FIG. 2 is an exploded, front perspective view of a plug connector of the communication system formed in accordance with an exemplary embodiment.

FIG. 2 is an exploded, front perspective view of the plug connector 108 showing the plug body 130 poised for loading into the plug shroud 140. One lossy insert 160 is illustrated in phantom in FIG. 2 in the plug body 130; however, the plug body 130 may include any number of lossy inserts 160.

The circuit board 142 is shown in FIG. 2 positioned behind the plug connector 108 and poised for loading into the terminating end 132 of the plug connector 108. The circuit board 142 includes a card edge 170 with signal conductors 172 and ground conductors 174 at or near the card edge 170. The circuit board 142 has a first side 176 and an opposite second side 178 with the signal and ground conductors 172, 174 on one or both of the sides 176, 178. Other components (for example, capacitors, resistors, diodes, processors, or other components) may be mounted to the first or second sides 176, 178 and electrically connected to corresponding conductors 172, 174. Optionally, a cable or another component may be mounted to the circuit board 142, such as at the opposite end. The signal and ground conductors 172, 174 may include traces, pads, plated vias, and the like.

The plug shroud 140 includes a cavity 144 that receives the plug body 130. The cavity 144 may be open at the front and at the rear of the plug shroud 140. The plug shroud 140 includes rails 146 extending rearward from the main body of the plug shroud 140 that defines the cavity 144. Optionally, the main body may entirely surround the cavity 144 (for example, on four sides of the cavity 144). The rails 146 define a receiving space therebetween configured to receive the electrical component 128 (for example, the circuit board 142, a wire harness or another type of electrical component 128). In an exemplary embodiment, the rails 146 include slots 148 that receive the circuit board 142. For example, the card edge 170 of the circuit board 142 may be loaded into the slots 148 in the receiving space, such as for mating with the signal and ground contacts 152, 154. The plug shroud 140 may include locating features for guiding mating and/or positioning with the plug body 130 and/or with the receptacle connector 104 (shown in FIG. 1). The plug shroud 140 may include securing features for securing to the plug body 130 and/or the receptacle connector 104 (shown in FIG. 1).

The plug body 130 includes a front tray 180 that extends to the mating end 134 and a rear base 182 that extends to the terminating end 132. The front tray 180 and/or the rear base 182 may receive the lossy inserts 160. The front tray 180 is configured to be loaded into the mating slot 118 (shown in FIG. 1) of the receptacle connector 104 when mated thereto. The rear base 182 is configured to be received in the cavity 144 of the plug shroud 140. In the illustrated orientation of the plug body 130, the first outer side 136 faces upwards and is visible, and the second outer side 138 faces downwards and is not visible, but may be similar or identical to the first outer side 138.

A first array of the signal and ground contacts 152, 154 is disposed at least partially along the first outer side 136, and a second array of the signal and ground contacts 152, 154 is disposed at least partially along the second outer side 138. For example, the signal contacts 152 and the ground contacts 154 are arranged in repeating GSSG sub-arrays across a lateral width of the front tray 180. At least portions of the signal and ground contacts 152, 154 are exposed along the front tray 180 for mating with the signal and ground conductors 122, 124 (shown in FIG. 1) of the electrical connector 104. For example, mating portions or mating ends 184 of the signal and ground contacts 152, 154 are exposed on the outer sides 136, 138.

The signal and ground contacts 152, 154 have terminating ends 186 generally opposite the mating ends 184. In the illustrated embodiment, the terminating ends 186 extend rearward of and are cantilevered from the terminating end 132 of the plug body 130, such as for terminating to the circuit board 142. The terminating ends 186, in the illustrated embodiment, include spring beams 188 configured to engage the signal and ground conductors 172, 174 of the circuit board 142. For example, the spring beams 188 may be elastically deflected outward when the circuit board 142 is loaded into a receiving space 190 defined between the rows of signal and ground contacts 152, 154, thus forming an internal spring force that presses the spring beams 188 against the signal and ground conductors 172, 174 to maintain the electrical connection with the signal and ground conductors 172, 174. Alternatively, the terminating ends 186 may be provided on the first and second outer sides 136, 138, such as in the form of solder pads, for termination to the electrical connector (for example, the circuit board 142, a wire harness, or other type of electrical connector), such as through a direct or indirect electrical connection.

In an exemplary embodiment, the plug body 130 includes signal contact channels 192 that receive signal contacts 152 and ground contact channels 194 that receive ground contacts 154. The contact channels 192, 194 may be open at the terminating end 132, such as to receive the contacts 152, 154 therethrough. The contact channels 192, 194 may be open along at least parts of the lengths thereof to the outer sides 136, 138, such as to expose the mating ends 184 of the contacts 152, 154. The contacts 152, 154 may be loaded into the corresponding contact channels 192, 194 through the rear or through the outer sides 136, 138. Alternatively, the plug body 130 may be overmolded over the first array and/or the second array. For example, the plug body 130 may be formed from two separate overmolded bodies that are coupled together to form the plug body 130. Optionally, upper and lower bands 196 may cover portions of the contact channels 192, 194 and the contacts 152, 154, such as to retain the contacts 152, 154 in the contact channels 192, 194. For example, the bands 196 may be provided at the rear base 182. In an exemplary embodiment, the lossy inserts 160 are aligned with, and may be exposed along, the ground contact channels 194, such as to allow coupling with the ground contacts 154.

Figure 3:
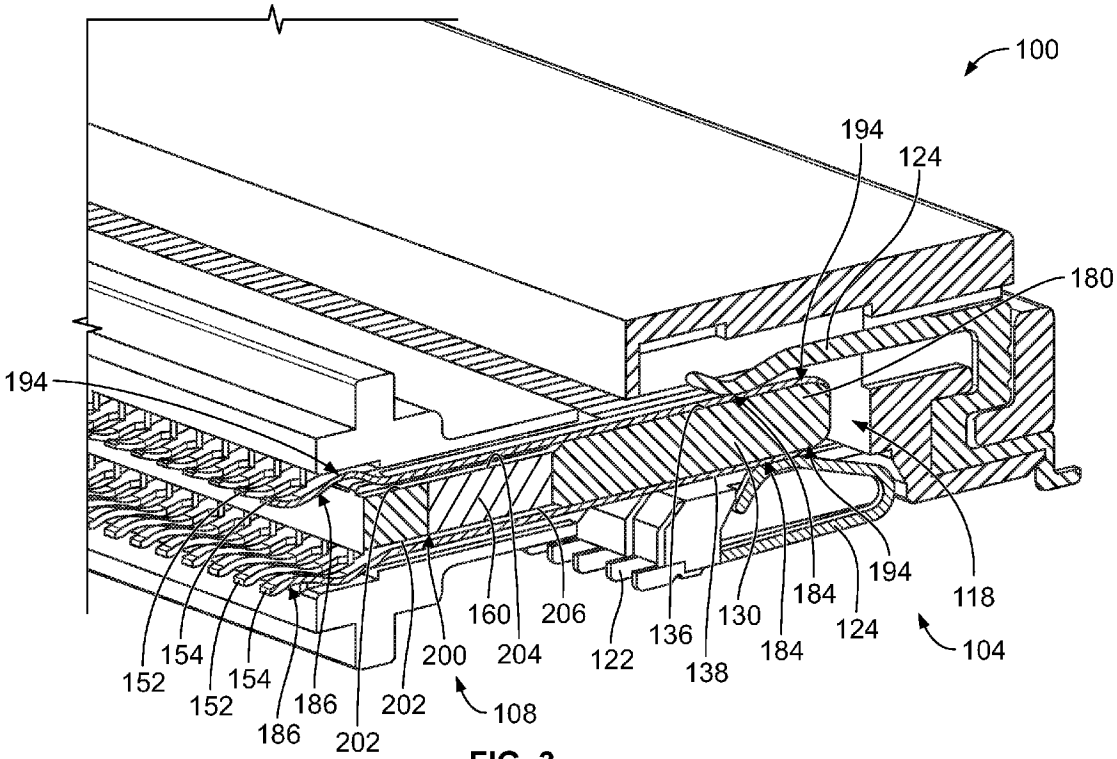
FIG. 3 is a cross-sectional view of the communication system in accordance with an exemplary embodiment.

FIG. 3 is a cross-sectional view of the communication system 100 in accordance with an exemplary embodiment. The communication system 100 includes the receptacle connector 104 and the plug connector 108. The plug connector 108 is loaded into the mating slot 118 of the receptacle connector 104 such that the mating ends 184 of the signal and ground contacts 152, 154 of the plug connector 108 are electrically connected with corresponding signal and ground conductors 122, 124 of the receptacle connector 104. The terminating ends 186 of the signal and ground contacts 152, 154 are configured to electrically connect to the electrical component 128 (shown in FIG. 1), which may be a circuit board, a wire harness or other type of electrical component in alternative embodiments. The terminating ends 186 may include a curved engagement interface for electrically connecting to the signal and ground conductors 172, 174 (shown in FIG. 2) of the circuit board 142 (shown in FIG. 2), such as an "S" shaped engagement interface.

As the front tray 180 is loaded into the mating slot 118 in a mating direction, the signal and ground conductors 122, 124 are deflected outward. The deflection of the signal and ground conductors 122, 124 biases the conductors 122, 124 towards the corresponding signal and ground contacts 152, 154 of the plug connector 108 to retain electrical engagement therebetween. The engagement between the corresponding signal conductors 122 and signal contacts 152 provides electrical signal paths between and across the connectors 104, 108. The engagement between the corresponding ground conductors 124 and ground contacts 154 provides electrical shielding between the signal paths and also provides electrical grounding paths between and across the connectors 104, 108. The lossy inserts 160 are electrically coupled to the grounding paths to absorb electrical resonance propagating through the communication system 100. The lossy inserts 160 provide resonance control to reduce resonant frequency noise spikes, thereby improving the electrical performance of the mated connectors 104, 108.

In an exemplary embodiment, the plug connector 108 electrically couples resonance-control lossy inserts 160 to each ground contact 154. The lossy inserts 160 may be directly coupled to each ground contact 154 in various embodiments. Alternatively, the lossy inserts 160 may be indirectly coupled, such as by capacitive coupling or providing another conductor therebetween. In the illustrated embodiment, the lossy inserts 160 are received in pockets 200 in the plug body 130. The pockets 200 may be molded into the dielectric body of the plug body 130. The lossy inserts 160 may be molded into the pockets 200, such as injection molded. For example, the plug body 130 may be molded in a multi-shot molding process, such as a two-shot molding process, where the lossy inserts 160 are co-molded with the plug body 130 from different materials, such as a lossy material and a low loss plastic material, respectively. Alternatively, the lossy inserts 160 may be molded separately and inserted into the pockets 200 during an assembly process.

The pockets 200 may be open at inner ends 202 of the ground contact channels 194 to receive the lossy inserts 160. In the illustrated embodiment, the pockets 200 extend entirely through the plug body 130 between the first and second outer sides 136, 138 and are open to both ground contact channels 194 at the opposite sides 136, 138, and thus the lossy inserts 160 are positioned between the ground contacts 124 on both sides 136, 138. In an exemplary embodiment, the pockets 200 are discrete pockets separated by the low loss dielectric material of the plug body 130; however, in alternative embodiments, the pockets 200 may be interconnected, such as by a central pocket that connects some or all of the pockets 200. Such central pocket may be filled with lossy material and define a lossy insert that passes horizontally within the thickness of the plug body 130 between the signal contacts 152 to interconnect the vertical lossy inserts 160 associated with each of the ground contacts 154.

The lossy inserts 160 may have any shape, such as a narrow box-shape, as in the illustrated embodiment. The lossy inserts 160 each include at least one edge facing and, in various embodiments, engaging a corresponding ground contact 154. In an exemplary embodiment, each lossy insert 160 includes a first edge 204 engaging the ground contact 154 in the contact channel 194 at the first outer side 136, and a second edge 206 engaging the ground contact 154 in the contact channel 194 at the second outer side 138. The edges 204, 206 may be provided at the inner ends 202 (for example, coplanar with the inner ends 202) and may define at least portions of the surfaces of the inner ends 202. In the illustrated embodiment, the edges 204, 206 are substantially parallel to each other; however, other orientations are possible in alternative embodiments. The lossy inserts 160 may have a similar width as the ground contacts 154. The lossy inserts 160 may have locking features that lock the lossy inserts 160 in the pockets 200, such as protrusions, dimples or other features.

Figure 4:
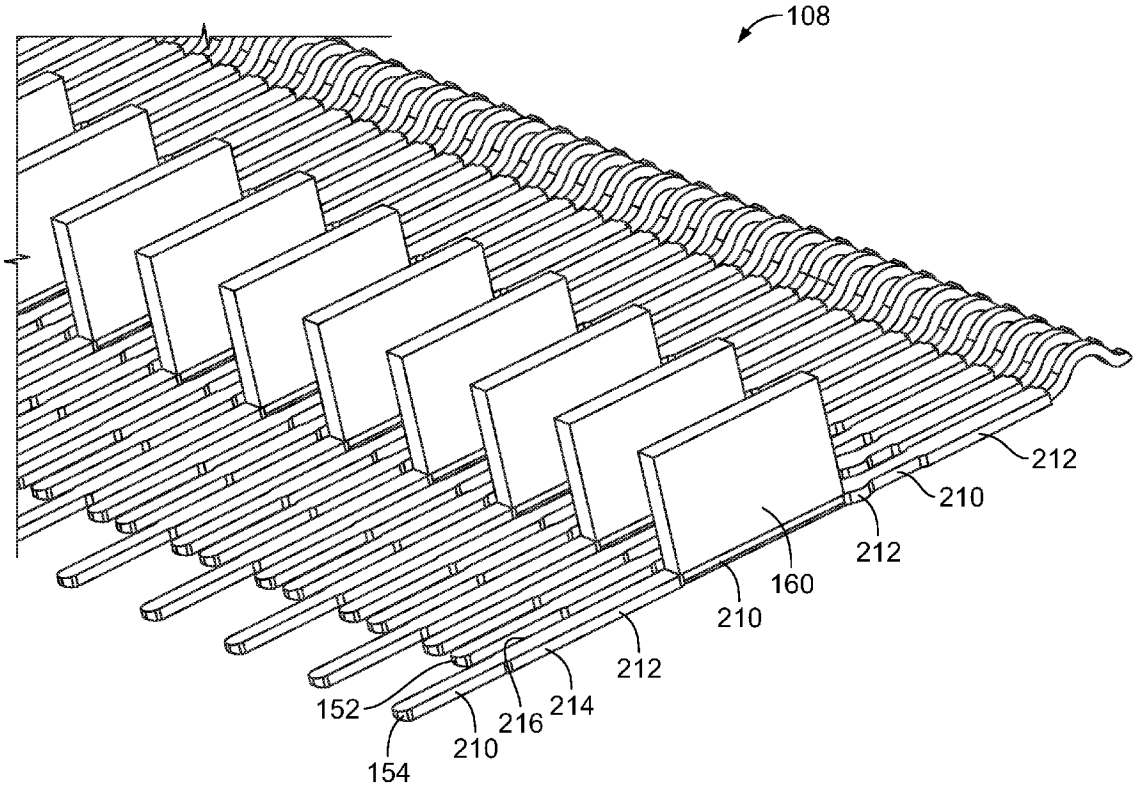
FIG. 4 is a perspective view of a portion of the plug connector in accordance with an exemplary embodiment.

FIG. 4 is a perspective view of a portion of the plug connector 108 showing the lossy inserts 160 and a lower array of signal and ground contacts 152, 154 with the plug body 130 removed to show the array of contacts 152, 154 and lossy inserts 160. FIG. 4 illustrates the lossy inserts 160 directly engaging the ground contacts 154. In an exemplary embodiment, the ground contacts 154 include one or more narrow sections 210 and one or more wide sections 212 between outer edges 214, 216 of the contacts 154. The wide sections 212 may be used to hold the contacts 154 in the plug body 130, such as by an interference fit. In an exemplary embodiment, the lossy inserts 160 may be aligned with corresponding narrow sections 210 of the ground contacts 154. The lossy inserts 160 may engage the ground contacts 154 at the narrow sections 210. The narrow sections 210 may be aligned with corresponding narrow sections of the signal contacts 152. The narrow sections 210 may be narrowed to control spacing between the signal and ground contacts 152, 154, such as for impedance control and/or to control spacing between the lossy inserts 160 and the signal contacts 152. Optionally, the lossy inserts 160 may extend along the edges 214, 216 at the narrow sections 210 to engage multiple sides of the ground contacts 154.

Figure 5:
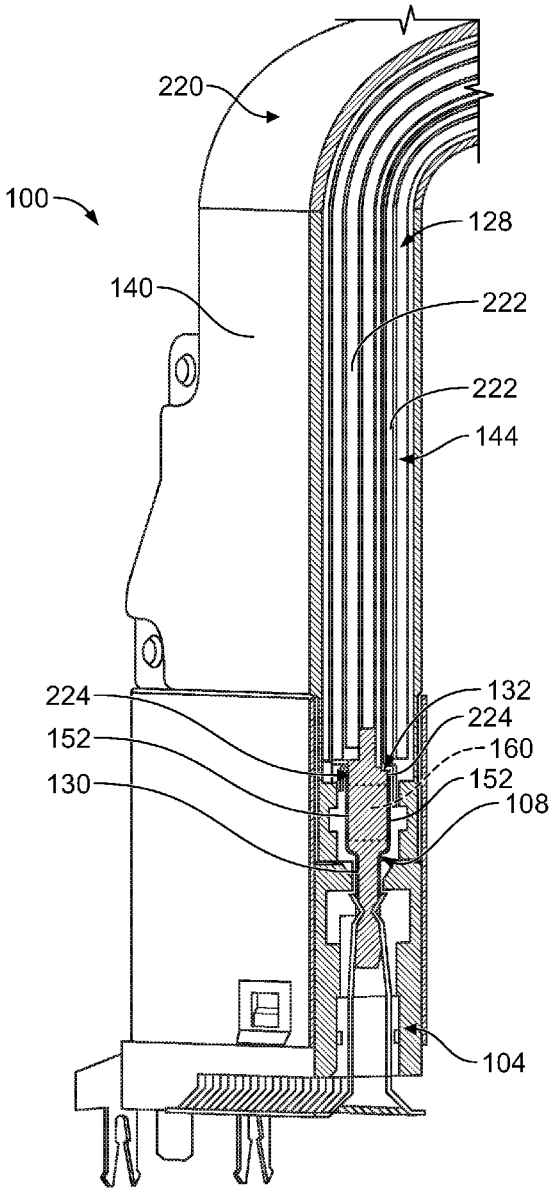
FIG. 5 is a partial sectional view of the communication system showing the plug connector of the communication system formed in accordance with an exemplary embodiment.

FIG. 5 is a partial sectional view of the communication system 100 showing the plug connector 108 mated to the receptacle connector 104. FIG. 4 also shows the electrical component 128 including a wire harness 220 (as opposed to the circuit board 142 shown in FIG. 1). The wire harness 220 includes a plurality of wires 222 terminated to corresponding signal contacts 152 and/or ground contacts 154 (shown in FIG. 2). The wires 222 may be soldered to the contacts 152. In an exemplary embodiment, the signal contacts 152 include contact pads 224 at the terminating end 132 of the plug body 130. The wires 222 are terminated to the contact pads 224. The plug shroud 140 surrounds the wires 222. For example, the wires 222 pass through the cavity 144 to terminate to the plug connector 108. The plug shroud 140 has a different shape in the illustrated embodiment for interfacing with the wire harness 220 (as opposed to the circuit board 142 shown in FIG. 1). The plug body 130 includes the lossy inserts 160 (shown in phantom) electrically coupled to the grounding paths to absorb electrical resonance propagating through the communication system 100. The lossy inserts 160 provide resonance control to reduce resonant frequency noise spikes, thereby improving the electrical performance of the mated connectors 104, 108.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A plug connector comprising:

a plug body having a terminating end configured to terminate to an electrical component and a mating end configured to mate with a mating electrical connector, the plug body having a first outer side and a second outer side, the plug body having pockets between the first and second outer sides;

a plug shroud extending from the plug body at the terminating end, the plug shroud being configured to be coupled to the electrical component;

a contact array held by the plug body, the contact array having signal contacts and ground contacts interleaved between corresponding signal contacts, the signal and ground contacts being exposed along the first and second outer sides, at least some of the ground contacts being aligned with corresponding pockets; and resonance-control lossy inserts provided in corresponding pockets adjacent corresponding ground contacts, the lossy inserts being manufactured from lossy material capable of absorbing electrical resonance propagating through the plug body, wherein each lossy insert ties a plurality of ground contacts together.

2. The plug connector of claim 1, wherein the lossy inserts span between the ground contacts at the first and second outer sides to couple to the ground contacts at both the first and second outer sides.

3. The plug connector of claim 1, wherein the lossy inserts directly engage corresponding ground contacts.

4. The plug connector of claim 1, wherein the lossy inserts are planar and spaced apart from each other along parallel ground planes.

5. The plug connector of claim 1, wherein each lossy insert includes a first edge and a second edge, the first edge engaging a corresponding ground contact, the second edge engaging a corresponding ground contact.

6. The plug connector of claim 1, wherein the signal and ground contacts are overmolded by at least one overmold body defining the plug body.

7. The plug connector of claim 1, wherein the plug body is manufactured from a low loss dielectric material, the lossy inserts being molded in the pockets in the plug body.

8. The plug connector of claim 1, wherein the plug body is manufactured from a low loss dielectric material, the lossy inserts being inserted into the pockets in the plug body.

9. The plug connector of claim 1, wherein the plug body includes a front tray and a rear base, the plug shroud surrounding the rear base, the front tray extending forward of the plug shroud with the signal and ground contacts exposed along the first and second outer surfaces of the front tray for mating with the mating electrical connector.

10. The plug connector of claim 1, wherein the plug shroud includes a slot configured to receive the electrical component for termination of the signal and ground contacts to the electrical component.

11. The plug connector of claim 1, wherein the signal and ground contacts include terminating ends extending rearward of the terminating end of the plug body for electrical termination to the electrical component.

12. The plug connector of claim 1, wherein the plug body includes signal contact channels receiving the signal contacts and ground contact channels receiving the ground contacts, the pockets and the lossy inserts being aligned with the ground contact channels and the ground contacts.

13. The plug connector of claim 1, wherein the signal contacts and the ground contacts form a plurality of ground-signal-signal-ground sub-arrays including a corresponding pair of signal contacts disposed between first and second ground contacts that separate the corresponding signal pair from adjacent signal pairs.

14. The plug connector of claim 1, wherein the ground contacts include narrow sections and wide sections between opposite first and second edges thereof, the lossy inserts being aligned with corresponding narrow sections of the ground contacts.

15. A plug connector comprising:

a circuit board having a card edge between first and second sides of the circuit board, the circuit board having signal and ground conductors on the first and second sides of the circuit board proximate to the card edge;

a plug body coupled to the card edge of the circuit board, the plug body having a terminating end terminated to the card edge of the circuit board and a mating end configured to mate with a mating electrical connector, the plug body having a first outer side and a second outer side, the plug body having pockets between the first and second outer sides;

a plug shroud extending from the plug body at the terminating end, the plug shroud receiving the card edge of the circuit board; and a contact array held by the plug body, the contact array having signal contacts and ground contacts interleaved between corresponding signal contacts, the signal and ground contacts being exposed along the first and second outer sides, at least some of the ground contacts being aligned with corresponding pockets, the signal and ground contacts having terminating ends extending from the terminating end of the plug body, the terminating ends of the signal and ground contacts being terminated to corresponding signal and ground conductors of the circuit board; and resonance-control lossy inserts provided in corresponding pockets adjacent corresponding ground contacts, the lossy inserts being manufactured from lossy material capable of absorbing electrical resonance propagating through the plug body.

16. The plug connector of claim 15, wherein the terminating ends of the signal and ground contacts are flexible spring beams extending rearward of the plug body in first and second rows to form a receiving space between the first and second rows of spring beams, the card edge being received in the receiving space and the spring beams engage the first and second sides of the circuit board such that the spring beams are deflected against the signal and ground conductors of the circuit board to electrically connect to the signal and ground conductors.

17. The plug connector of claim 15, wherein the lossy inserts span between the ground contacts at the first and second outer sides to couple to the ground contacts at both the first and second outer sides.

18. A plug connector comprising:

a wire harness having a plurality of wires; and a plug body provided at the end of the wire harness, the plug body having a terminating end and a mating end opposite the terminating end configured to mate with a mating electrical connector, the plug body having a first outer side and a second outer side, the plug body having pockets between the first and second outer sides;

a plug shroud extending from the plug body at the terminating end, the plug shroud defining a cavity receiving the wires of the wire harness;

a contact array held by the plug body, the contact array having signal contacts and ground contacts interleaved between corresponding signal contacts, the signal and ground contacts being exposed along the first and second outer sides, at least some of the ground contacts being aligned with corresponding pockets, the signal and ground contacts having terminating ends, the terminating ends being electrically connected to corresponding wires of the wire harness; and resonance-control lossy inserts provided in corresponding pockets adjacent corresponding ground contacts, the lossy inserts being manufactured from lossy material capable of absorbing electrical resonance propagating through the plug body.

19. The plug connector of claim 18, wherein the terminating ends of the signal and ground contacts are solder pads, the wires being soldered to the solder pads.

* * * * *